United States Patent [19]

Kubo et al.

[11] Patent Number: 4,874,666

[45] Date of Patent: Oct. 17, 1989

[54] POLYOLEFINIC BICONSTITUENT FIBER AND NONWOVE FABRIC PRODUCED THEREFROM

[75] Inventors: Eiichi Kubo; Koichi Nagaoka; Yoshiki Miyahara, all of Kyoto; Syunichi Kiriyama, Nara; Yasunobu Mishima, Kyoto, all of Japan

[73] Assignee: Unitika Ltd., Hyogo, Japan

[21] Appl. No.: 142,962

[22] Filed: Jan. 12, 1988

[30] Foreign Application Priority Data

| | | | |
|---|---|---|---|
| Jan. 12, 1987 | [JP] | Japan | 62-5586 |
| Mar. 11, 1987 | [JP] | Japan | 55806 |
| Mar. 11, 1987 | [JP] | Japan | 55807 |
| May 30, 1987 | [JP] | Japan | 137512 |

[51] Int. Cl.[4] ..... D02G 3/04; C08L 23/08; C08L 23/12

[52] U.S. Cl. ..... 428/398; 428/397; 428/401; 428/364; 525/240

[58] Field of Search ..... 428/401, 364, 397, 398; 525/240

[56] References Cited

U.S. PATENT DOCUMENTS

| | | | |
|---|---|---|---|
| 4,563,504 | 1/1986 | Hert et al. | 525/240 |
| 4,632,861 | 12/1986 | Vassilatos | 525/240 |

FOREIGN PATENT DOCUMENTS

| | | |
|---|---|---|
| 0154197 | 9/1985 | European Pat. Off. . |
| 3544523 | 6/1986 | Fed. Rep. of Germany . |
| 1129052 | 12/1981 | Japan . |

*Primary Examiner*—Carman J. Seccuro

*Attorney, Agent, or Firm*—Sughrue, Mion, Zinn, Macpeak & Seas

[57] ABSTRACT

A biconstituent fiber having good spinnability, a binder fiber made thereof, and a nonwoven fabric produced therefrom and which has high tensile strength and comfortable soft touch are provided. The biconstituent fiber is composed of linear low-density polyethylene and crystalline polypropylene and may be hollow or flat in cross section. A binder fiber may be produced from a bicomponent structure in which the biconstituent fiber serves as a sheath component and polyethylene terephthalate as a core component.

7 Claims, No Drawings

POLYOLEFINIC BICONSTITUENT FIBER AND NONWOVE FABRIC PRODUCED THEREFROM

FIELD OF THE INVENTION

The present invention relates to a polyolefinic biconstituent fiber and a nonwoven fabric produced therefrom.

BACKGROUND OF THE INVENTION

Nonwoven fabrics which contain fibers having different melting temperatures are well known in the field of the nonwoven fabrics. The fibers with the lower melting point act as an adhesive agent which bonds the higher melting-point fibers to each other. Fibers containing polyethylene and polypropylene are often used to manufacture nonwoven fabrics because of their desirable characteristics such as comparatively low melting point, a strong bond between fibers and a good hand of the fibers. However, since polyethylene is difficult to be spun into filaments at high speed, it has not been easy to produce polyethylene/polypropylene containing nonwovens in accordance with a spunbonding process comprising continuous spinning and web forming operations. Low-density and high-density polyethylenes have been used as polyethylene fibers. It has recently been proposed that a linear low-density polyethylene (hereinafter abbreviated as LLDPE) prepared by copolymerizing ethylene and an $\alpha$-olefin having 3 to 12 carbon atoms as described in Japanese Patent Application (OPI) No. 209010/85 (the term "OPI" as used herein means an "unexamined published Japanese patent application") or a blend of specified proportions of low-density polyethylene and crystalline polypropylene (as described in U.S. Pat. No. 4,632,861) are used in the production of polyolefin fibers. A growing need for spinning at higher speeds exists today not only in the art of making spunbonded nonwoven fabrics but also for the purpose of reducing the production cost of multifilaments. However, the LLDPE shown in Japanese Patent Application (OPI) No. 209010/85 which is specified to have a density and a melt index (hereinafter referred to as MI value) within certain ranges is difficult to spin at high speed and its spinnability is also unsatisfactory. Fibers of fine denier can be spun at high speed by employing a spinning temperature that is much higher than the melting point of LLDPE, but at the same time, the surface of spinneret tends to be soiled over time, thereby inducing such troubles as kneeling and filament breakage.

As regards the blend of low-density polyethylene and polypropylene, U.S. Pat. No. 4,632,861 discloses a process for producing blend fiber and nonwoven fabric by the following procedures: melt-spinning the blend to form a first group of filaments; quenching the first group of filaments; bringing the first group of filaments together with a second group of filaments which have a higher melting point than the polyethylene component of the first group of filaments; forming a composite web of the two groups of filaments; and bonding the web by compressing the web while heating it to a temperature above the melting point of the polyethylene component. Although the low-density polyethylene specified in this patent has a melting point of less than 107° C., the melt spinning of the blend is performed at a temperature in the range of 205 to 265° C., preferably between 230° C. and 260° C. This should increase the chance of the surface of spinneret of becoming soiled over time, thereby inducing such troubles as kneeling and filament breakage. Furthermore, the highest spinning speed that could be attained was only 4,600 m/min for a given blend ratio at a spinning temperature of 260° C.

In the production of nonwoven fabrics, fiber-to-fiber bonds are introduced by interlacing fibers as in the case of needle punch method or by employing a variety of adhesive agents as binders. In applications such as inner cover-stock for disposable diapers and sanitary napkins the demand for which has increased rapidly these days, the nonwoven fabrics are required to satisfy various properties such as soft hand (comfortable touch to the skin), lightweightness (light weight) and high tensile strength. In order to satisfy these requirements as much as possible, the binder method has been employed as a common technique for producing nonwoven fabrics. The principal approach of binding has been to deposit a solution of adhesive agent on webs but this suffers from such disadvantages as the extra need for energy in order to remove the solvent used in the solution of adhesive agent and the fouling of a working environment due to solvent stripping.

With a view to solving these problems, it has been proposed that a first group of fibers constituting a web is bonded together by incorporating in the web a binder in the form of a second group of fibers having a lower melting point than the first group of fibers, with the web being then subjected to a heat treatment. For example, Japanese Patent Publication No. 10583/86 proposes that a bicomponent fiber made of fiber-forming polymers having different melting points is used as a binder for nonwoven fabrics having high strength and good hand. Low-density polyethylene (LDPE) and high-density polyethylene (HDPE) are commonly used as the bicomponent fiber-forming polymers but nonwoven fabrics produced using these polyethylenes are unsatisfactory in that they have rigid hand and fail to offer a soft feel. In order to eliminate this defect, it has been proposed in Japanese Patent Application (OPI) Nos. 209010/85 and 194113/85 that LLDPE fibers prepared by copolymerizing ethylene with octene-1 be used as a binder for nonwoven fabrics because they offer soft hand and have a low melting point. However, staple fibers made by using LLDPE as a binder are only insufficiently crimped to provide a desired degree of bulkiness.

SUMMARY OF THE INVENTION

An object, therefore, of the present invention is to solve the aforementioned problems of the prior art and to provide a polyolefinic biconstituent fiber that can be spun into filaments in a consistent way over time and which is adapted to high-speed spinning.

Another object of the present invention is to provide a nonwoven fabric of soft hand using this improved polyolefinic biconstituent fiber.

In a first aspect, the present invention provides a biconstituent fiber produced by melt-spinning a blend comprising 99 to 50 wt % of a linear low-density polyethylene that is a linear low-density copolymer of ethylene and at least one $\alpha$-olefin having 4 to 8 carbon atoms substantially present in an amount of 1 to 15 wt % and which has a density of 0.900 to 0.940 g/cm$^3$, a melt index of 25 to 100 g/10 min as measured by the method specified in ASTM D-1238(E), and a heat of fusion of at least 25 cal/g, and 1 to 50 wt % of a crystalline polypropylene having a melt flow rate of less than 20 g/10 min as measured by the method specified in ASTM D-1238(L).

In a second aspect, the present invention provides a nonwoven fabric produced from the biconstituent fiber.

In a third aspect, the present invention provides a binder fiber having such a cross-sectional shape that a core of polyethylene terephthalate is coated with a biconstituent fiber produced by melt-spinning a blend comprising 99 to 50 wt % of a linear low-density polyethylene that is a linear low-density copolymer of ethylene and at least one α-olefin having 4 to 8 carbon atoms present substantially in an amount of 1 to 15 wt % and which has a density of 0.900 to 0.940 g/cm$^3$, a melt index of 25 to 100 g/10 min as measured by the method specified in ASTM D-1238(E), and a heat of fusion of at least 25 cal/g, and 1 to 50 wt % of a crystalline polypropylene having a melt flow rate of less than 20 g/10 min as measured by the method specified in ASTM D-1238(L).

In a fourth aspect, the present invention provides a nonwoven fabric produced from the binder fiber.

The heat of fusion which characterizes the linear low-density polyethylene in the biconstituent fiber of the present invention is measured as follows: about 5 mg of a sample is heated in a differential scanning calorimeter (Model DSC-2 manufactured by Perkin-Elmer Co., Ltd.) from room temperature at a scan rate of 20° C./min and the heat of fusion of the sample is determined from the resulting DSC curve in accordance with the operating manual of the apparatus.

DETAILED DESCRIPTION OF THE INVENTION

The LLDPE to be used in the biconstituent fiber of the present invention is a copolymer of ethylene and at least one α-olefin having 4 to 8 carbon atoms; this copolymer substantially contains 1 to 15 wt % of the α-olefin. Illustrative α-olefins having 4 to 8 carbon atoms are α-ethylenically unsaturated alkenes such as butene1, 4-methylpetene-1, hexene-1, and octene-1. Copolymers prepared by copolymerizing ethylene with these α-olefins have good miscibility with polypropylene. If α-olefin having 3 carbon atoms is used as the component to be copolymerized with ethylene, only fibers having rigid hand will result irrespective of the molar ratio at which the propylene is copolymerized with ethylene. If α-olefins having 9 or more carbon atoms are copolymerized with ethyene, fibers, that have a good thermal bonding capability and which have a soft hand, can be obtained, but these fibers have low crystallinity and tenacity. In addition to ethylene and at least one α-olefin having 4 to 8 carbon atoms, the copolymer may contain another α-olefin of 4 to 8 carbon atoms in an amount of not more than 15 wt % of the first α-olefin.

The LLDPE for use in the present invention may also contain any suitable additive such as a hygroscopic agent, a lubricant, a pigment, a stabilizer or a flame retardant.

The biconstituent fibers prepared in accordance with the present invention are suitable for use as binder fibers or in the making of nonwoven fabrics of either continuous filaments or staple fibers. Biconstituent fibers composed of coarse filaments will not produce good hand, so fibers having a fineness of filaments exceeding 5 deniers are excluded from the scope of the present invention.

If the LLDPE used in the present invention contains more than 15 wt % of an α-olefin having 4 to 8 carbon atoms, it becomes difficult to obtain fibers of fine denier by high-speed spinning. If, on the other 15 hand, the LLDPE contains less than 1 wt % of an α-olefin having 4 to 8 carbon atoms, the resulting fibers are rigid and are incapable of being processed into nonwoven fabrics having a good hand. If the LLDPE used in the present invention has a density higher than 0.940 g/cm$^3$, fibers, that are lightweight and which have soft hand cannot be obtained. If the density of LLDPE is less than 0.900 g/cm$^3$, the tenacity of the polyethylene component is insufficient to produce fibers of high performance by melt-spinning.

A particularly important aspect of the bi-constituent fiber of the present invention lies in the melt viscosities of polyethylene and polypropylene. If the MI value of LLDPE is less than 25 g/10 min, its melt viscosity is too high to produce fibers of fine denier by high-speed spinning. If the MI value of LLDPE exceeds 100 g/10 min, the two components have so much different viscosities that a uniform blend cannot be obtained during melt spinning and a serious defect will take place in that the filaments being extruded will frequently break as they emerge from the spinneret. For the reasons stated above, the LLDPE must have a MI value in the range of 25 to 100 g/10 min. A preferred range is 35 to 80 g/10 min, with the range of 40 to 70 g/10 min being most preferred. If the LLDPE has heat of fusion below 25 cal/g, no uniform blend will be obtained (for yet to be clarified reasons) and it is difficult to obtain fibers of fine denier by high-speed spinning. The crystalline polypropylene which is used as the other component of the biconstituent fiber of the present invention is isotactic polypropylene. The melt flow rate of this polypropylene must be not more than 20 g/10 min. Polypropylene having a melt flow rate exceeding this value cannot be uniformly blended with LLDPE by any of the known commonly employed spinning apparatus and great difficulty is involved in spinning at high speed.

In order to produce the biconstituent fiber of the present invention, LLDPE and crystalline polypropylene, each being in chip form, may be blended and subjected to spinning with any of the known commonly employed spinning apparatus. It should, however, be noted that the adaptability of the blend at high speed is influenced by the ratio at which LLDPE is blended with crystalline polypropylene. Stated specifically, a blend containing more of the crystalline polypropylene than LLDPE is difficult to spin at high speed. The spinnability of the blend is related to phase separation between the two components in a molten state. The structure of the blend is such that LLDPE serving as a sea component is interspersed with a polypropylene island component both in transverse and axial directions of fiber. Spinnability is governed by the size of the island component. If the melt viscosities of the two components are very close, the size of the island component becomes small and the blend exhibits too high a melt elasticity to be smoothly spun at high speed. If, on the other hand, the melt viscosities of the two components differ greatly, the size of the island component becomes too great to ensure smooth spinning at high speed, since both components will be extruded in a coarse form.

The biconstituent fiber of the present invention which consists of the above-specified LLDPE and polypropylene present in the above-specified amounts has the advantage of having significantly improved spinnability as compared with the prior art products. In the present invention, spinnability is measured in terms of maximum spinning speed which is defined as the speed at which fibers can be continuously spun for 6 hours with a minimum occurrence of kneeling (filament bending just below the nozzle) and with no more than one fiber breakage taking place per hour. The maximum spinning speed, as defined above, of the biconstituent fiber of the present invention is significantly improved over the conventional blend of polyethylene and polypropylene.

In producing staple fibers, the spinning speed is usually in the range of 1,000 to 1,600 m/min and need not be as fast as required in making continuous filaments. However, ideal staple fibers must satisfy rigorous requirements for high bulkiness and good blendability with other fibers. The number of crimps in the key to satisfying these performance requirements of staple fibers and in order to produce satisfactory staple fibers, they must be provided with 10 to 40 crimps per inch as measured by the method specified in JIS L-1015. Another important feature of the staple fibers produced by the present invention is that they can be crimped with great ease. This is because each of the LLDPE and polypropylene to be blended together is highly crystalline and has good heat-settability. Despite their highly crystalline nature, the staple fibers produced by the present invention are LLDPE-rich and offer soft hand.

Fibers and nonwoven fabrics having characteristic hand can be produced from biconstituent fibers that are hollow or flat in cross section. Hollow fibers and nonwoven fabrics formed of the hollow fibers have a high degree of bulkiness and exhibit good heat-insulating effects. Flat fibers and nonwoven fabrics made of the flat fibers will offer an even softer feel. The good spinnability of the biconstituent fiber of the present invention is particularly notable when hollow fibers are melt-spun as compared with the case of melt spinning circular solid fibers, and depending upon the melt-spinning temperature (for its discussion, see below), the effect of polymer's melt elasticity on the Barus effect (which correlates with the nozzle geometry and the cooling rate of melt-spun fibers) can be reduced. This is effective in reducing the variations of tension on fibers being melt-spun and, thus, minimizing the frequency of filament breakages so as to improve the maximum spinning speed defined above.

Hollow fibers prepared by the present invention are not limited to those having only one hollow portion; instead, they may be "porous" hollow fibers having many hollow portions. A preferred degree of hollowness is in the range of 3 to 50%. If the degree of hollowness exceeds 50%, spinnability is deteriorated and fibrillation will occur in the .fibers produced. If the degree of hollowness is less than 3%, lightweight fibers cannot be produced and one of the objects of the present invention fails to be attained.

If flat fibers are to be prepared by the present invention, their degree of flatness is preferably in the range of 1.5 to 4.0. If the degree of flatness is greater than 4.0, the spinnability of the fibers is deteriorated and the resulting fibers will have only low tenacity. If the degree of flatness is less than 1.5, it becomes difficult to attain a characteristic soft touch.

For the purposes of the present invention, the percentage of hollowness of a hollow fiber is determined by the formula $d^2/D^2 \times 100$ (%), where D is the diameter of the outer shell and d is the diameter of the hollow portion, of the filament being observed with a microscope. In case of a filament containing n hollow portions in the form of pores, the percentage of hollowness is to be determined by the formula $n \times (d^2/D^2) \times 100$ (%). If the filament of interest is a hollow fiber having a modified shaped cross section, the percentage of its hollowness is determined by: $(a/A) \times 100$ (%), where A is the cross-sectional area of the filament and a is the cross-sectional area of the hollow portion both parameters being measured with an image processing system (LUZEX-II manufactured by Nireco Co., Ltd.).

The degree of flatness of flat fibers is determined by the formula L/l, where L and l denote the lengths of the major and minor axes, respectively, of the elliptical portion of the filament being observed with a microscope.

Hollow fibers and flat fibers can be used either in the form of continuous filaments or staple fibers. Either type of fibers or yarns may be mixed with a solid circular biconstituent fiber prepared in accordance with the present invention, or with other fibers. Which mode should be selected will entirely depend upon the intended use and capabilities of the final product.

The biconstituent fiber of the present invention may be combined with polyethylene terephthalate to make a bicomponent fiber in which the biconstituent fiber serves as a sheath component and the polyethylene terephthalate serves as a core component. Polyethylene terephthalate as a core component preferably has an intrinsic viscosity of 0.50 to 1.20 as measured at 20° C. in a 1:1 mixed solvent of phenol and tetrachloroethane. If polyethylene terephthalate has an intrinsic viscosity of less than 0.50, the resulting fibers do not have a sufficiently high tenacity to produce satisfactory nonwoven fabrics. If the intrinsic viscosity of polyethylene terephthalate exceeds 1.20, high spinnability is not ensured. The polyethylene terephthalate to be combined with the biconstituent fiber of the present invention may contain in it a suitable additive such as a lubricant, a pigment or a stabilizer.

When the biconstituent fiber of the present invention is combined with polyethylene terephthalate to make a bicomponent fiber, the biconstituent fiber (sheath component) is preferably used in an amount of 20 to 80 wt %, whereas polyethylene terephthalate (core component) is used in an amount of 80 to 20 wt %. If the proportion of the sheath component is less than 20 wt %, fibers of high tenacity are produced, but they have low adhesive strength and hard hand so that satisfactory binder fibers or nonwoven fabrics cannot be attained. Nonwoven fabrics made of binder fibers that contain more than 80 wt % of the sheath component have a good hand, but their tenacity is undesirably low.

Another important feature of the present invention is that by blending the specified proportions of polyethylene and polypropylene each having the specified properties, high-speed spinning can be accomplished at a lower temperature than those optimum for the respective polymers. In other words, by blending LLDPE having the specified properties with crystalline polypropylene having the specified melt viscosity, it becomes possible to perform high-speed spinning even at a lower spinning temperature. This is effective in preventing the soiling of spinneret which has been a major problem encountered in the prior art where spinning is performed at high temperatures. The present inventors already showed in Japanese Patent Application No. 126745/86 filed on May 31, 1986. The Patent is showed that nonwoven fabric is produced by melt-extruding specified LLDPE and selecting spinning temperature. A spinning temperature of amount 250° C. is commonly employed to achieve high-speed spinning of LLDPE, whereas 270° C. or thereabouts are used with crystalline polypropylene. The biconstituent fiber of the present invention can be spun at 200° to 250° C., preferably at 210° to 230° C.

A bicomponent fiber composed of polyethylene terephthalate and the biconstituent fiber of the present invention can be produced by spinning with a known bicomponent melt-spinning apparatus. In this case, the sheath component is suitably spun at a temperature which is approximately intermediate between the spinning temperatures for LLDPE and polypropylene; a preferred spinning temperature is 200° to 250° C., more preferably 220° to 240° C. Polyethylene terephthalate serving as the core component is preferably spun at 275° to 295° C.

If spinning is performed outside the ranges specified above, smooth operations are not ensured and nonwoven fabrics of satisfactory quality cannot be obtained. If the spinning temperature is lower than the values specified above, high spinning speeds are difficult to attain and satisfactory nonwoven fabrics cannot be produced from continuous filaments of fine denier. Furthermore, the air pressure of the air gun must be increased and the resulting nonwoven fabric will have an increased number of defects due to the frequent breakage of filaments during spinning The spinning speed for making staple fibers is in the range of 1,000 to 1,600 m/min at maximum, so spinning is possible at low temperatures; however, frequent breakage of filaments occurs and the product obtained is again a bundle of staple fibers of low quality.

If the spinning temperature is higher than the values specified above, the chance of the soiling of nozzle surface is increased, and if the operation lasts for a prolonged period, breakage of filaments due to the soiled nozzle surface reduces the operational efficiency, and thereby leading to the production of highly defective fibers and nonwoven fabrics. In order to avoid this problem, the nozzle surface must be cleaned periodically and at short intervals, which will simply result in increased production loss. This tendency is particularly notable in the case of producing a bicomponent fiber of polyethylene terephthalate and a biconstituent fiber. However, in the present invention, the typical melt-spinning temperature is 230° C. for the biconstituent fiber and 285° C. for polyethylene terephthalate. Since the differences between these melt-spinning temperatures and the melting points of the respective components are not great, the filaments of bicomponent fiber after being melt-extruded can be smoothly cooled to minimize the residual strain that might occur in the filaments on account of nonuniform cooling. As a result, the bicomponent fiber obtained is uniform and has good spinnability. This is effective in significantly reducing all of the troubles, such as a soiled nozzle spinneret, kneeling (filament bending just below the nozzle) and filament breakage, that have been observed in the prior art on account of the use of melt-spinning temperatures that are too high for LLDPE.

The occurrence of troubles such as a soiled nozzle spinneret and breakage of filaments should be avoided as much as possible when making spunbonded nonwoven fabrics. If a breakage of filaments occurs, the resulting spunbonded nonwoven fabric will always suffer from unevenness in weight or have a large defect. In the presence of large defects, a nonwoven fabric of light weight (10 to 30 g/m$^2$) will break, wrinkle or puckering as it is unrolled in a subsequent processing step, and this results in the production of a final product having a poor appearance. Such defective products have eventually to be eliminated at the delivery stage.

The fiber of the present invention is adapted to high-speed spinning, so it is best suited for making nonwoven fabrics by the spunbonding process, in which extruded filaments are sucked with a high-speed air gun that traverses, from side to side above a moving collection blet, on which the filaments are deposited in a layered arrangement to form a web, which is guided to embossed rolls for being compressed and heat-treated to make a nonwoven fabric. Alternatively, the fiber may be spun at conventional low speeds (1,000 to 1,600 m/min) and the resulting undrawn filaments are wound up on a bobbin, followed by thermal drawing and crimping. The crimped filaments are cut to staple fibers of a suitable length and may be processed into a nonwoven fabric. If desired, the fiber of the present invention may be mixed with other staple fibers to make binder fibers suitable for use in the production of nonwoven fabrics.

In order to increase the tensile strength of the resulting nonwoven web and to inhibit the formation of a nonwoven fabric having fuzzy surface fibers while retaining the soft touch of the biconstituent fiber or LLDPE, the interlaced filaments in the web are subsequently bonded together by a suitable means such as embossed heated rolls. The temperature used in this thermal bonding step will influence the hand and tensile strength of the nonwoven fabric to be finally obtained. In the present invention, thermal bonding is performed by heating the web at a temperature in the range of from 15° to 30° C. below the melting point of the LLDPE component of the biconstituent fiber, and this is effective in providing a nonwoven fabric that simultaneously satisfies the requirements for good hand and high tensile strength. If the surface temperature of a heating device such as embossed heated rolls is higher than a level 15° C. below the melting point of LLDPE, a nonwoven fabric having high tensile strength is obtained but its hand or texture is undesirably hard. If the surface temperature of a heating device is lower than a level 30° C. below the melting point of LLDPE, a nonwoven fabric of good hand is obtained but its tensile strength is not satisfactorily high because of insufficient bonding between filaments.

The above-described temperature for thermal bonding or heat treatment is valid only for nonwoven fabrics having a soft hand, and in the case of making a nonwoven fabric that has a different hand such as a paper-like texture combined with an extremely low air permeability, the temperature for thermal bonding or heat treatment may be elevated to the higher side so as to ensure sufficient fluidity of LLDPE. Therefore, the temperature for thermal bonding or heat treatment may be properly selected depending upon the use or object of a specific product.

The biconstituent fiber and binder fiber of the present invention is useful in the production of nonwoven fabrics which are made of continuous filaments or staple fibers. The resulting nonwoven fabric has a high tensile strength and is excellent in terms of both softness and hand. Therefore, nonwoven fabrics of light weight made in accordance with the present invention are particularly suitable for use as linings on disposable diapers, and those having heavy weight are useful in a broad range of applications including bags, carpet base fabrics and filters.

The biconstituent fiber and binder fiber of the present invention have another advantage in that they can be laminated with other fiber materials or mixed with other fibers.

The following examples are provided for the purpose of further illustrating the present invention but are in no way to be taken as limiting. The particular procedures that were used to determine the various characteristics reported herein were as follows.

(1) Number of crimps: Measured in accordance with JIS L-1015

(2) Percentage crimp, crimp elasticity and residual percentage crimp: All measured in accordance with JIS L-1074.

(3) Tensile strength of nonwoven fabric: Maximum tensile strength was measured on test strips 3 cm wide and 10 cm long in accordance with the strip method described in JIS L1096.

(4) Total hand of nonwoven fabric: Being a measure of softness, this parameter was measured in accordance with the handleometer method described in JIS L-1096, with the slot width set at 10 mm.

(5) Softness of nonwoven fabric: A test piece was cut from a sample of nonwoven fabric and shaped into a cylinder 50 mm high with a circumference of 100 mm. The cylindrical test piece was placed on a plate-type load cell, and the maximum load that was applied when the test piece collapsed after being compressed at a rate of 50 mm/min was measured.

(6) Weight: Measured in accordance with JIS P-8142.

EXAMPLE 1

Various types of polyethylene and polypropylene were prepared a characterized in Table 1.

TABLE 1

| Type | Symbols A LLDPE | B LLDPE | C LLDPE | D LDPE | E HDPE | F isotactic PP | G isotactic PP |
|---|---|---|---|---|---|---|---|
| Octene-1 content (wt %) | 5 | 5 | 5 | 0 | 0 | 0 | 0 |
| Density (g/cm$^3$) | 0.935 | 0.930 | 0.930 | 0.915 | 0.961 | 0.905 | 0.905 |
| MI value (g/10 min) | 43 | 19 | 120 | 50 | 35 | 15 | 28 |
| Heat of fusion (cal/g) | 36 | 30 | 25 | 33 | 67 | — | — |

Note:
LLDPE, LDPE, HDPE and PP given in Table 1 denote linear low-density polyethylene, low-density polyethylene, high-density polyethylene, and polypropylene, respectively.

Filaments were melt-spun from the respective types under the conditions noted in Table 2. Symbols A to G in Table 2 are keyed to those used in Table 1. In all instances, spinning was performed using a spinneret having 80 holes with a diameter of 0.4 mm. The throughput per hole was 1.5 g/min. The results of evaluation of the spinnability of each sample are shown in Table 3, and the fiber properties of each sample is shown in Table 4. The sample numbers noted in Tables 3 and 4 are in correspondence with those given in Table 2.

TABLE 2

| Sample No. | Polyethylene/Polypropylene Blending Weight Ratio | Spinning Temperature (°C.) |
|---|---|---|
| 1. Comparison | 100% A | 250 |
| 2. Invention | 95% A and 5% F | 220 |
| 3. Invention | 75% A and 25% F | 220 |

TABLE 2-continued

| Sample No. | Polyethylene/Polypropylene Blending Weight Ratio | Spinning Temperature (°C.) |
|---|---|---|
| 4. Invention | 50% A and 50% F | 220 |
| 5. Comparison | 25% A and 75% F | 220 |
| 6. Comparison | 5% A and 95% F | 220 |
| 7. Comparison | 100% F | 270 |
| 8. Comparison | 75% B and 25% F | 220 |
| 9. Comparison | 75% C and 25% F | 220 |
| 10. Comparison | 75% D and 25% F | 220 |
| 11. Comparison | 75% E and 25% F | 220 |
| 12. Comparison | 75% A and 25% G | 220 |

TABLE 3

| Sample No. | Evaluation of Spinnability: Spinning Speed*1 (m/min) | Soiling of Spinneret*2 | Frequency of Filament Breakages*3 (number/hr) |
|---|---|---|---|
| 1. Comparison | 8,500 | x | 0.9 |
| 2. Invention | 8,300 | O | no breakage |
| 3. Invention | 8,800 | O | no breakage |
| 4. Invention | 8,000 | O | no breakage |
| 5. Comparison | 3,300 | O | 0.7 |
| 6. Comparison | 600 | O | 0.7 |
| 7. Comparison | 4,800 | O | no breakage |
| 8. Comparison | 1,900 | O | 0.7 |
| 9. Comparison | impossible | x | — |
| 10. Comparison | 3,050 | Δ | 0.6 |
| 11. Comparison | impossible | O | — |
| 12. Comparison | impossible | O | — |

Note
*1"Impossible" means that spinning was impossible.
*2After one hour spinning of filaments, the degree of soiling of the spinneret surface was rated by the following criteria: O: good and no nozzle soiling, Δ: somewhat poor and limited nozzle soiling, x: extensive nozzle soiling and kneeling occurred.
*3For each sample, spinning was performed for 6 hours and the results of observation of the filament breakages for each hour were averaged.

TABLE 4

| Sample No. | Fiber Properties: Denier (d) | Tenacity (g/d) | Elongation (%) |
|---|---|---|---|
| 1. Comparison | 1.6 | 2.43 | 171 |
| 2. Invention | 1.6 | 2.44 | 205 |
| 3. Invention | 1.5 | 2.62 | 184 |
| 4. Invention | 1.7 | 2.31 | 252 |
| 5. Comparison | 4.1 | 1.08 | 715 |
| 6. Comparison | 22.5 | evaluation impossible | evaluation impossible |
| 7. Comparison | 2.8 | 1.98 | 630 |
| 8. Comparison | 7.1 | evaluation impossible | evaluation impossible |
| 9. Comparison | — | — | — |
| 10. Comparison | 4.4 | 0.81 | 320 |
| 11. Comparison | — | — | — |
| 12. Comparison | — | — | — |

As is clear from Tables 1 to 4, filaments of high properties could not be efficiently spun from blends of polyethylene and polypropylene unless they satisfied the requirements of the present invention for the proportions and characteristics of the two constituents. For example, comparative sample No. 1 (solely made of LLDPE) and sample No. 3 (a biconstituent fiber according to the present invention) were both satisfactory in terms of spinning speed and the fiber properties and the hand. But, as for spinnability, comparative sample No. 1 was inferior to sample No. 3 and experienced frequent filament breakages owing to extensive soiling of the spinneret. Similar results were observed when the blending ratio of polyethylene and polypropylene was outside the scope specified by the present invention; when the proportion of polypropylene exceeded 50 wt % of the biconstituent fiber as in the case of comparative sample Nos. 5 and 6, spinnability was also deteriorated. Comparative sample Nos. 8, 9 and 12 used polyethylene and polypropylene having MI values or melt flow rates that were outside the scope specified by the present invention. Comparative sample No. 10 employed low-density polyethylene and comparative sample No. 11 used high-density polyethylene, which were also outside the scope of the present invention; as with the other comparative samples, these comparative samples had poor spinnability.

EXAMPLE 2

A blend of 75 wt % LLDPE and 25 wt % crystalline polypropylene was processed as in the case of sample No. 3 prepared in Example 1 except that the spinning temperature was 220° C. and the spinning speed was 8,800 m/min. The air gun traversed, from side to side above a moving collection belt, on which filaments were deposited in a layered arrangement to form a web, which was subsequently guided to pass between embossed rolls so that they were compressed and heated to make a nonwoven fabric. The resulting nonwoven fabric was a sheet having superior properties with soft hand. Having a filament fineness of 1.5 deniers, a weight of 10 g/m$^2$, a tensile strength of 0.90 kg/3 cm and a total hand of 6 g, this nonwoven fabric was suitable for use as inner cover stock for disposable diapers.

EXAMPLE 3

Filaments were melt-spun from a blend of 75 wt % of LLDPE (octene-1 content: 5 wt %, density: 0.935 g/cm$^3$, MI value, 43 g/10 min, heat of fusion: 36 cal/g) and 25 wt % of isotactic polypropylene (density: 0.905 g/m$^3$, melt flow rate: 15 g/10 min) at a spinning temperature of 230° C. through a spinneret having 158 holes with a diameter of 0.4 mm. The throughput per hole was 1.5 g/min and the spun filaments were wound up at a speed of 1,200 m/min. The filaments were then drawn by 5.6 folds at a temperature of 100° C. The drawn filaments were crimped in a stuffing box to make short staple fibers having a length of 51 mm. The staple fibers obtained had the following properties: fiber length of 51 mm; filament fineness of 2 deniers; tenacity of 2.5 g/d; breaking elongation of 65%; number of crimps of 20 per inch; percentage crimp of 11%; crimp elasticity of 67%; and residual percentage crimp 11%.

EXAMPLE 4

The staple fibers prepared in Example 3 were supplied to a card machine to form a web having a weight of 30 g/m$^2$. The web was guided to pass between embossed rolls so that it was thermally bonded to make a nonwoven fabric. The nonwoven fabric thus produced had soft hand (softness, 28 g) and high tensile strength (tensile strength, 1.7 kg/3 cm).

EXAMPLE 5

Filaments were melt-spun from a blend of 75 wt % of LLDPE (butene-1 content: 4 wt %, density: 0.935 g/cm$^3$, MI value: 30 g/10 min, heat of fusion: 37 cal/g) and 25 wt % of isotactic polypropylene (density: 0.905 g/cm$^3$, melt flow rate: 15 g/10 min) at a spinning temperature of 230° C. through a spinneret having 80 holes with a diameter of 0.4 mm. The throughput per hole was 1.5 g/min and the filaments were spun at a speed of 8,000 m/min. The filaments were deposited on a moving collection belt as in Example 2 to form a web, which was thermally bonded with embossed rolls to make a nonwoven fabric of continuous filaments. The resulting nonwoven fabric had soft hand (total hand, 6 g). The other properties of the fabric were as follows: filament fineness of 1.7 deniers; weight of 10 g/m$^2$; tensile strength of 0.85 kg/3 cm; and total hand of 6 g.

EXAMPLE 6

Hollow fibers having a circular cross section were melt-spun from a blend of 75 wt % of LLDPE (octene-1 content: 5 wt %, density: 0.935 g/cm$^3$, MI value measured by a method of ASTM D-1238(E): 43 g/10 min, het of fusion measured by DSC, 36 cal/g) and 25 wt % of isotactic polypropylene (density: 0.905 g/cm$^3$, melt flow rate: 15 g/10 min) at a spinning temperature of 230° C. through a spinneret having 18 ()-shaped orifices (cf. Japanese Pat. No. 1,271,094). The throughput per hole was 1.5 g/min and the filaments were spun at a speed of 8,800 m/min.

an air gun traversed from side to side over a moving collection belt, on which the filaments were deposited in a layered arrangement to form a web having a weight of 10 g/cm$^2$. The web was then guided to pass between embossed rolls so as to make a nonwoven fabric.

The properties of the hollow fibers and the woven fabric produced therefrom are shown in Table 5.

REFERENCE EXAMPLE 1

(Example comparing hollow fibers and solid fibers)

A nonwoven fabric of continuous filaments was produced as in Example 6 except that the spinneret having ()-shaped orifices was replaced by a spinneret having circular orifices with a diameter of 0.4 mm and that the spinning speed was changed to 8,500 m/min. The properties of the solid fibers and the nonwoven fabric produced therefrom are shown in Table 5.

TABLE 5

| | Spinnability | | Yarn | | | | | Nonwoven Fabric | | | |
|---|---|---|---|---|---|---|---|---|---|---|---|
| | Frequency of Filament Breakage (number/hour) | Soiling of Spinneret (number/hour) | Degree of Hollowness (%) | Filament Diameter (μ) | Filament Fineness (d) | Tenacity (g/d) | Elongation (%) | Weight (g/m$^2$) | Tensile Strength (kg/3 cm) | Total Hand (g) | Bulkiness |
| Example 6 | None | O | 30 | 17.4 | 1.5 | 2.6$^2$ | 184 | 10 | 1.13 | 6.2 | High |

TABLE 5-continued

| | Spinnability | | Yarn | | | | | Nonwoven Fabric | | | |
|---|---|---|---|---|---|---|---|---|---|---|---|
| | Frequency of Filament Breakage (number/hour) | Soiling of Spinneret (number/hour) | Degree of Hollowness (%) | Filament Diameter (μ) | Filament Fineness (d) | Tenacity (g/d) | Elongation (%) | Weight ($g/m^2$) | Tensile Strength (kg/3 cm) | Total Hand (g) | Bulkiness |
| Comparative Example 1 | None | O | — | 15.6 | 1.6 | 2.4[3] | 171 | 10 | 0.85 | 6.0 | low |

The good spinnability of the two samples was established by performing an evaluation of the frequency of filament breakages and soiling of the spinneret as in Example 1. The nonwoven fabric made in Example 6 had the higher tensile strength because it was produced from hollow fibers that were bonded broadly in area at the cross over point of each filaments. The softness originating from the olefinic fibers was fully reflected in the nonwoven fabric of Example 6, which also had a high degree of bulkiness due to the use of hollow fibers. Evaluation of bulkiness was conducted by visually checking the height of a stack of a given number of nonwoven fabrics under test. The nonwoven fabric made in Comparative Example 1 had only a low degree of bulkiness, because it was produced from solid, rather than hollow, fibers. Furthermore, the tensile strength of this nonwoven fabric was low since only a small bonding areas were created between the fibers during thermal bonding with embossed rolls.

EXAMPLE 7

Flat filaments were melt-spun from a blend of 75 wt % of LLDPE (octene-1 content: 5 wt %, density: 0.935 $g/cm^3$, MI value: 43 g/10 min, heat of fusion: 36 cal/g) and 25 wt % of isotactic polypropylene (density: 0.905 $g/cm^3$, melt flow rate: 15 g/10 min) through a plurality of nozzles each having 64 holes with a slit length of 0.6 mm and a slit width of 0.1 mm. The throughput per hole was 1.5 g/min and the polymer temperature was set at 230° C. Using an air gun, the flat filaments were gathered into a bundle at a spinning speed of 7,000 m/min and deposited on a moving collection belt in a layered arrangement to form a web, which was processed as in Example 6 to make a spunbonded nonwoven fabric. The flat filaments of which the nonwoven fabric were composed had a flatness degree of 2.5 and a filament fineness of 1.9 deniers. The nonwoven fabric had a very soft hand (total hand, 4 g), a weight of 10 $g/m^2$ and a tensile strength of 0.8 kg/3 cm.

EXAMPLE 8

Filaments were spun from a bicomponent structure consisting of a cor (50 wt %) of polyethylene terephthalate (intrinsic viscosity, 0.70) and a sheath (50 wt %) of a blend of 75 wt % of LLDPE and 25 wt % of polypropylene. The LLDPE contained 5 wt % octene-1 and had a density of 0.935 $g/cm^3$, a melt index of 43 g/10 min and a heat of fusion of 36 cal/g. The polypropylene was isotactic and had a density of 0.905 $g/cm^3$ and a melt flow rate of 15 g/10 min. The core component (polyethylene terephthalate) was spun at 285° C. and the sheath component (blend of LLDPE and isotactic polypropylene) at 220° C. The spinneret had 36 holes each having a diameter of 0.4 mm. The throughput per hole was 1.5 g/min and the spinning speed was 8,800 m/min. Continuous filaments could be smoothly produced without causing any substantial soiling of the spinneret. The filaments produced had satisfactory fiber properties: filament fineness of 1.52 deniers; tenacity of 2.61 g/d; and breaking elongation of 99%.

EXAMPLE 9

An air gun traversed from side to side above a moving collection belt, on which the filaments of 1.52 deniers spun in Example 8 were deposited in a layered arrangement to form a web having a weight of 10 $g/m^2$. The web was guided to pass between embossed rolls so that it was compressed and heat-treated to make a nonwoven fabric. This nonwoven fabric had soft hand (total hand, 10.0 g) and a high tensile strength (maximum tensile strength, 1.1 kg/3 cm).

EXAMPLE 10

Filaments were spun from a bicomponent structure consisting of a core (50 wt %) of polyethylene terephthalate (intrinsic viscosity, 0.70) and a sheath (50 wt %) of a blend of 75 wt % of LLDPE and 25 wt % of polypropylene. The LLDPE contained 5 wt % octene-1 and had a density of 0.935 $g/m^3$, a melt index of 43 g/10 min and a heat of fusion of 36 cal/g. The polypropylene was isotactic and had a density of 0.905 $g/cm^3$ and a melt flow rate of 15 g/10 min. The core component (polyethylene terephthalate) was spun at 285° C. and the sheath component (blend of LLDPE and isotactic polypropylene) a 220° C. The spinneret had 200 holes with a diameter of 0.4 mm. The throughput per hole was 2.0 g/min and the spinning speed was 1,600 m/min. The spinning operation was smooth. The spun filaments were drawn by 3.1 folds at a temperature of 100° C. The drawing operation was also smooth. The drawn filaments were crimped in a stuffing box to produce staple fibers having a length of 51 mm without involving any trouble in the crimping operation.

The undrawn filaments had a fineness of 11 deniers, a tenacity of 1.32 g/d and an elongation of 305%. The stable fibers produced by drawing and crimping these filaments had the following properties: fiber length of 51 mm; filament fineness of 3.5 deniers; tenacity of 4 g/d; breaking elongation of 41%; number of crimps of 20 per inch (2.54 cm); percentage crimp of 10.5%; crimp elasticity of 68%; and residual percentage crimp of 12%.

EXAMPLE 11

The staple fibers produced in Example 10 were supplied to a card machine to form a web having a weight of 10 $g/m^2$. The web was guided to pass between embossed rolls so that it was compressed and heat-treated to make a nonwoven fabric. This nonwoven fabric was found to develop a maximum tensile strength of 1.5 kg/3 cm and to display a softness of 12.5 g.

EXAMPLE 12

Forty wt % of the staple fibers prepared in Example 10 was mixed with 60 wt % of the staple fibers of polyethylene terephthalate having a fineness of 3.0 deniers and a fiber length of 51 mm. The mixture was supplied to a card machine to make a web having a weight of 10.0 g/m$^2$, which was then heat-treated to produce a nonwoven fabric. The staple fibers of polyethylene terephthalate had the following properties: tenacity of 4.5 g/d; elongation of 40%; number of crimps of 20/inch (2.54 cm); percentage crimp of 12%; crimp elasticity of 70%; and residual percentage crimp of 14%. The resulting nonwoven fabric was strong (tensile strength, 0. kg/3 cm) and had good hand (softness, 6.0 g).

While the invention has been described in detail and with reference to specific embodiments thereof, it will be apparent to one skilled in the art that various changes and modifications can be made therein without departing from the spirit and scope thereof.

What is claimed is:

1. A biconstituent fiber produced by melt-spinning a blend comprising 99 to 50 wt % of a linear low-density polyethylene that is a linear low-density copolymer of ethylene and at least one α-olefin having 4 to 8 carbon atoms substantially present in an amount of 1 to 15 wt % and which has a density of 0.900 to 0.940 g/cm$^3$, a melt index of 25 to 100 g/10 min as measured by the method specified in ASTM D-1238(E), and a heat of fusion of at least 25 cal/g, and 1 to 50 wt % of a crystalline polypropylene having a melt flow rate of less than 20 g/10 min as measured by the method specified in ASTM D-1238(L).

2. A biconstituent fiber as claimed in claim 1, wherein said α-olefin having 4 to 8 carbon atoms is octene-1.

3. A biconstituent fiber as claimed in claim 1, wherein said fiber has a fineness of no greater than 5 deniers.

4. A biconstituent fiber as claimed in claim 1, wherein said fiber is composed of continuous filaments.

5. A biconstituent fiber as claimed in claim 1, wherein said fiber is composed of staple fibers, provided with 10 to 40 crimps per inch.

6. A biconstituent fiber as claimed in claim 1, wherein said hollow fiber has a hollowness of 3 to 50% in its cross section.

7. A biconstituent fiber as claimed in claim 1, wherein said flat fiber has a flatness degree of 1.5 to 4.0.

* * * * *